US006020095A

United States Patent [19]

Cote et al.

[11] Patent Number: 6,020,095

[45] Date of Patent: Feb. 1, 2000

[54] SYSTEM AND METHOD FOR TESTING CHEMICALS IN AN ON-LINE WET CHEMICAL PROCESSOR IN AN IMAGESETTING SYSTEM

[75] Inventors: James K. Cote, Nashua, N.H.; Arthur R. Newton, Jr., North Reading, Mass.

[73] Assignee: Agfa Corporation, Wilmington, Del.

[21] Appl. No.: 09/240,986

[22] Filed: Jan. 29, 1999

[51] Int. Cl.[7] ..... G03C 5/395; G03C 5/31

[52] U.S. Cl. ..... 430/30; 430/398; 430/399

[58] Field of Search ..... 430/30, 398, 399

[56] References Cited

U.S. PATENT DOCUMENTS

| | | | |
|---|---|---|---|
| 5,616,452 | 4/1997 | Gogle et al. | 430/398 |
| 5,769,301 | 6/1998 | Hebert et al. | 226/108 |

OTHER PUBLICATIONS

U.S. application No. 09/240,985 (Agfa case No. XP–0523) filed Jan. 29, 1999 by Libor Krupica et al.

*Primary Examiner*—Hoa Van Le

*Attorney, Agent, or Firm*—Robert A. Sabourin

[57] ABSTRACT

An imagesetting system includes: an imagesetter for photographically recording an image onto media; a wet chemical processor, proximately positioned adjacent to the imagesetter, for receiving and processing the imaged media, and a light-tight control wedge box containing a test strip to be processed by the wet chemical processor, without physically separating the imagesetter and the processor, to indicate whether chemicals in the wet chemical processor are depleted below a level of effectiveness. The imagesetting system operates in a test mode to determine whether chemicals in the processor are depleted below the level of effectiveness. The test mode method includes the steps of: stopping the imagesetter from photographically recording an image onto the media and stopping the imagesetter from transferring media to the processor; installing the control wedge box into the imagesetting system without physically separating the imagesetter and processor; and running a sequence of operations to extract the test strip from the control wedge box and to transfer the test strip through the processor to determine whether chemicals within the processor are depleted below the level of effectiveness.

6 Claims, 3 Drawing Sheets

SYSTEM AND METHOD FOR TESTING CHEMICALS IN AN ON-LINE WET CHEMICAL PROCESSOR IN AN IMAGESETTING SYSTEM

FIELD OF THE INVENTION

This invention relates generally to an imagesetting system and method in a pre-press environment having an imagesetter and an on-line wet chemical processor, and more specifically, to a system and method for testing chemicals in the on-line wet chemical processor using test strips without having to physically separate the imagesetter from the processor.

BACKGROUND OF THE INVENTION

In electronic pre-press systems, images to be printed by offset printing are scanned from photographic sources and digitized. The digitized images are transmitted to a raster image processor (RIP) for half-tone screening and image rasterization. The rasterized image is then transmitted to an imagesetter for photographic recording. Such recording is referred to as imaging or imagesetting, and may for example be performed by photographic recording of an image onto a photosensitive medium such as paper, film or a printing plate. A medium which has had an image recorded onto it by an imagesetter is referred to as "imaged medium".

Existing pre-press systems typically include independent functional units such as an imagesetter for photographically recording images onto media, and a wet chemical processor for developing, fixing and washing the exposed media. A typical photographic imagesetter operates to record a predefined image onto a medium, for example by first mounting the medium onto the internal surface of a drum (i.e. in an internal drum imagesetter), then exposing the medium with a laser beam via a rotatable, optically reflective element mounted along the longitudinal axis of the drum. The medium typically may be supplied as a web or as a cut sheet.

Subsequent to imaging, the imaged medium is passed to a wet chemical processor, where the medium will undergo chemical processing for photographically developing, fixing and washing. If the media was supplied by a continuous web, each sheet of exposed media is cut prior to entry into the processor.

The active chemicals within the fluids in the processor are used to develop, fix and wash the exposed media. These chemicals gradually become inactive, depleted or ineffective over time. At some point, these fluids need to be replenished to be effective, i.e., they drop below a level of effectiveness. Hence, it is desirable to provide a system and method for periodically testing these chemicals. Furthermore it is desirable to implement a system for testing these chemicals which is implemented with minimal effort on the part of an operator, and which will otherwise minimally disrupt the normal operation of the imagesetting system.

SUMMARY

The above-identified and other problems are overcome by an imagesetting system which includes: an imagesetter for photographically recording an image onto media; a wet chemical processor, proximately positioned adjacent to the imagesetter, for receiving and processing the imaged media, and a light-tight control wedge box containing a test strip to be processed by the wet chemical processor, without physically separating the imagesetter and the processor, to indicate whether chemicals in the wet chemical processor are depleted below a level of effectiveness.

The method for testing whether chemicals in the processor are depleted below the level of effectiveness includes the steps of: stopping the imagesetter from photographically recording an image onto the media and stopping the imagesetter from transferring media to the processor; installing the wedge control box into the imagesetting system without physically separating the imagesetter and processor; and running a sequence of operations to extract the test strip from the wedge control box and to transfer the test strip through the processor to determine whether chemicals within the processor are depleted below the level of effectiveness.

It is an object of the present invention to provide a system and method for testing the chemicals in fluids within a wet chemical processor of an imagesetting system without physically separating the imagesetter from the processor. It is another object of the present invention to minimize the down time of the imagesetting system while testing the chemicals in the processor. It is yet another object of the present invention to simplify the testing procedure for the operator of the imagesetting system.

BRIEF DESCRIPTION OF THE DRAWINGS

The invention will be more fully understood by reference to the following detailed description of the preferred embodiments, viewed in conjunction with the drawings which are not necessarily drawn to scale.

DETAILED DESCRIPTION OF THE PREFERRED EMBODIMENTS

Figure 1:
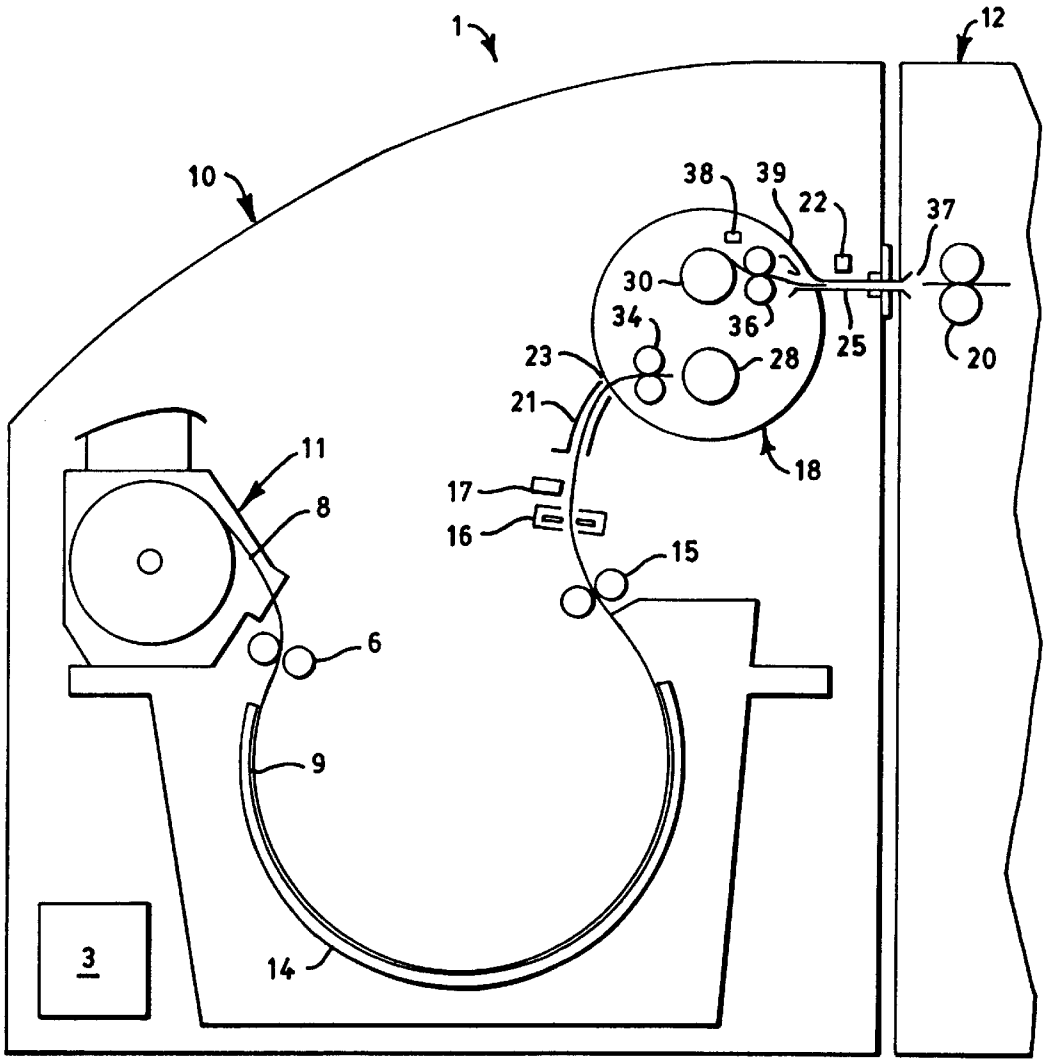
FIG. 1 is a schematic view of an imagesetting system including an imagesetter and a wet chemical processor.

FIG. 1 is a schematic view of selected portions of an imagesetting system 1 including an internal drum imagesetter 10 and an on-line wet chemical processor 12. An "on-line" processor is defined here to mean a processor which is physically connected or proximate to the imagesetter so that media is automatically transferred from the imagesetter to the processor in accordance with a predetermined sequence of operations. The imagesetter 10 includes: a media supply cassette 11 which supplies a photosensitive media 8 as a web; drum input rollers 6; an imaging drum 14; drum output rollers 15, web cutters 16; a first sensor 17; a transfer buffer 18; a second sensor 22; and a programmable controller 3. The controller 3 automatically controls and runs the programmed sequence of operations of the imagesetting system 1. The processor 12 includes a pair of input rollers 20.

After imaging, the media 8 is transferred from the drum 14 to the transfer buffer 18 via drive rollers 15. The media is transferred through a media path from the drum 14 which in this example is defined as the media path traversing from the rollers 15 to the opening 23 between the platens 21. After a predetermined length of the media 8 passes by the sensor 17, the cutters 16 cut the media. The sheet of cut, imaged media entering the transfer buffer 18 continues being drawn into the transfer buffer 18 by drive rollers 34 until the trailing edge (not shown) of the sheet is in the vicinity of the opening 23. A next section of the media 8 is now positioned in the drum 14 and ready for imaging. The operations of the imagesetting system 1 are controlled by a pre-installed software program in the controller 3. Moreover, the web supply roll 11 of FIG. 1 may be replaced by a source of precut sheets of media.

During operation of the imagesetting system 1 of FIG. 1, a portion of the media 8 resident in the media supply cassette 11 is drawn onto the internal drum surface 9 of the drum 14 via drive rollers 6. A laser imaging system (not shown) transfers and records an image onto the media resident within the drum. The laser imaging system typically includes a laser diode located at or near the main central axis of rotation of the drum on a carriage that allows translation along the drum axis. The output beam from the laser diode is scanned by a rotating mirror across the media on surface 9 in successive circumferentially extending bands or paths referred to as scan lines. The laser diode output beam exposes specific pixel locations of the media along those scan lines to form the desired image. Since the imaged media is associated with a single color component of the image, the laser diode is turned-on or off for those pixel locations that contain that color component, depending on whether a positive or negative image is being generated.

As described above, sheets of cut, imaged media are moved into the transfer buffer 18 after imaging in the drum 14. There they are stored in one of the storage devices 28 or 30, before being transferred to the processor 12. This particular embodiment of an imagesetter, which uses a transfer buffer 18, is described in U.S. patent application Ser. No. NOT YET ASSIGNED (Agfa case no. XP-0523), filed on Jan. 29, 1999 by Krupica et al., and incorporated by reference in its entirety for supplemental background information which is not essential but is helpful in appreciating the applications of the present invention.

The internal components of the imagesetter 10 are accessible to an operator, for instance, by a door (not shown) which opens from the top of the imagesetter 10. Thus, when the operator desires to test the chemicals within the wet processor 12, he or she opens the imagesetter door, and installs a control wedge box 40 as shown in FIGS. 2 and 3.

Figure 2:
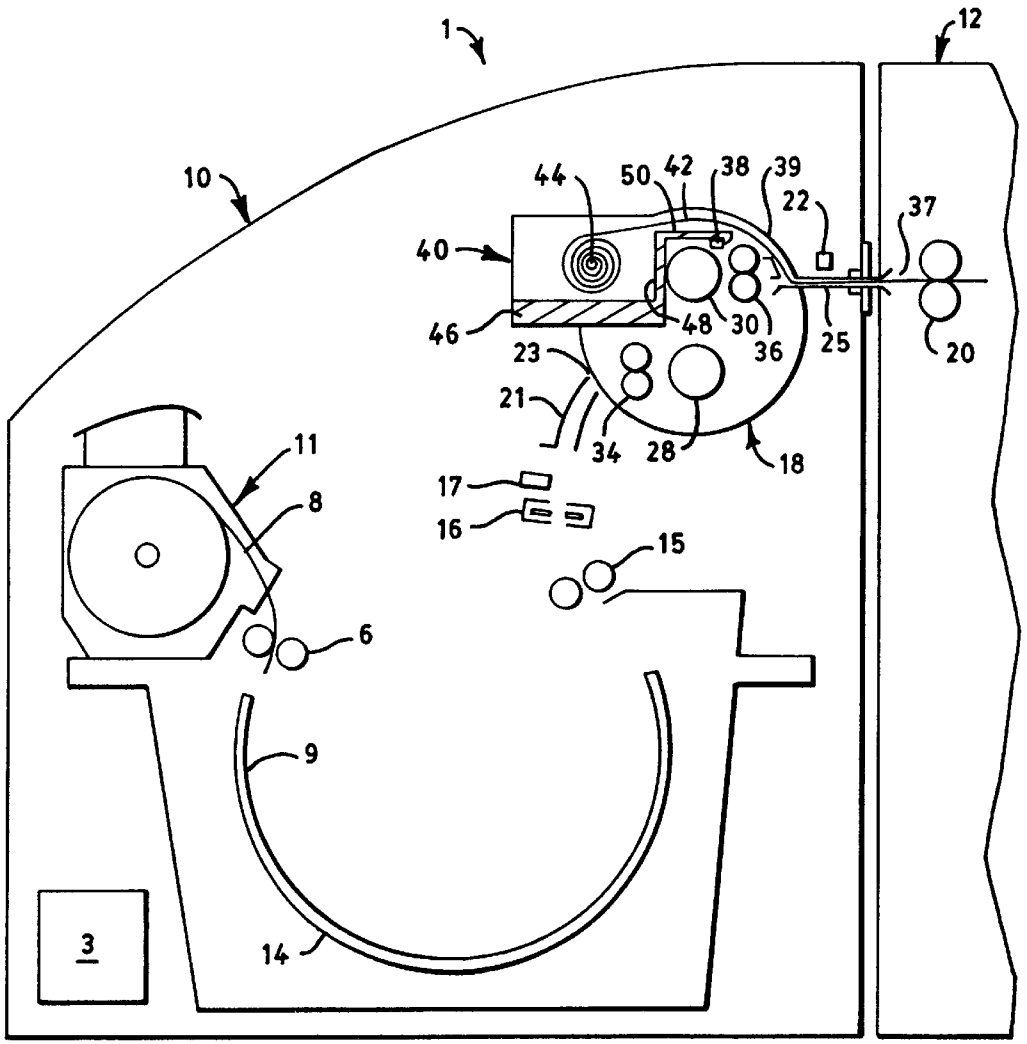
FIG. 2 illustrates the imagesetter of FIG. 1 having a control wedge box installed for testing chemicals within the processor.
Figure 3:
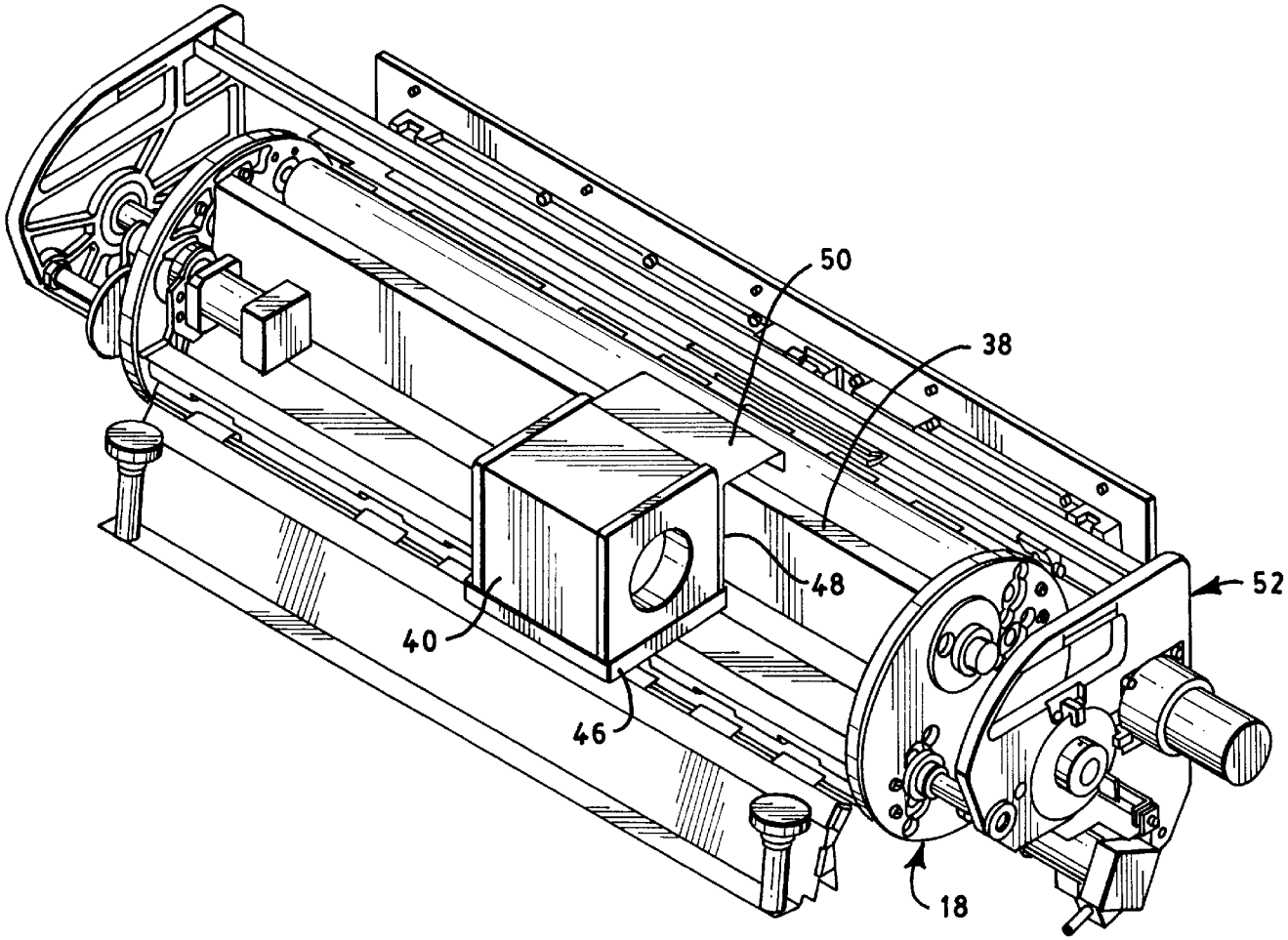
FIG. 3 is a detailed perspective view of a portion of the imagesetter of FIG. 1 having a control wedge box installed for testing chemicals within the processor.

FIG. 2 illustrates the imagesetter of FIG. 1 having a control wedge box 40 installed for testing chemicals within the processor 12. FIG. 3 is a detailed perspective view of a portion of the imagesetter of FIG. 1 with the control wedge box 40 installed. The control wedge box 40 is a light-tight container which houses pre-exposed test media 42 wound about a core 44. The control wedge box 40 can be conceptually compared to a light-tight photographic cassette for housing film for a camera.

The controller 3 operates and controls the imagesetting system 1 in a number of different operating modes which are selectable by an operator via a control console or separate computer (not shown) including standard peripheral devices such as a display monitor, a keyboard and a mouse. In a test mode of operation, imaging in the drum 14 and transfer of imaged media from the imagesetter 10 to the processor 12 is shut down, i.e. the basic operations of the imagesetter 10 are halted. The wet chemical processor 12 continues to operate in a normal mode of operation so that a test strip can be processed therethrough. The test strip will be processed through a typical sequence of chemical baths such as a development bath, a fixing bath and one or more wash baths.

After halting operation of the imagesetter 10, the operator opens the door on the top of the imagesetter 10 to install the control wedge box 40 therein. The box 40 is supported, for instance, by a support frame which includes a base 46, a front wall 48 and a hook section 50. The hook section 50 is hung over an accepting surface or support assembly, shown for purposes of illustration as a support bar 38, within the imagesetter 10. FIG. 3 shows detail of the transfer buffer 18 which includes the support bar 38 and a mounting assembly 52. The operator next feeds a protruding end of the test strip 42 into the platen 39. When the leading edge of the test strip passes the detector 22, the detector 22 will send a signal to the controller 3 which in turn will activate the input rollers 20 of the processor 12. Thus, as the operator continues to feed the test strip 42 through the platen 39 then through platen 25, the rollers 20 will engage the test strip 42 and automatically continue to draw it into the processor 12. The test strip 42 is preferably a continuous pre-imaged strip of media which needs to be manually cut by the operator after a desired length has passed into the processor 12. The test strips could be marked for cutting at a particular length, or alternatively, the wedge control box 40 could contain individual pre-cut test strips.

When the wet chemical processor 12 completes processing of the test strip 42, the processed test strip is examined to determine whether the chemicals in the processor 12 remain effective. Fluids within the various chemical baths are thus replenished as necessary by the system operator.

Although the best mode for implementing the present invention is described herein, many variations exist for implementing the general concepts of the invention within a pre-press imagesetting system. For instance, the control wedge box 40 or its equivalent could be physically located within the imagesetter, within the processor, or external to but adjacent to either of these functional system components. The control wedge box could be permanently affixed, or designed into, any imagesetter or processor, or it could be removable as described above. The control wedge box is not limited to use with an imagesetter having a transfer buffer 18. For instance, some imagesetters use a transport bridge assembly for transporting media from the imagesetter to the wet chemical processor (see U.S. Pat. No. 5,769,301 issued Jun. 23, 1998 to Hebert et al., herein incorporated by reference in its entirety for supplemental background information which is not essential but is helpful in appreciating the applications of the present invention). The principles of the present invention thus can certainly be applied to an imagesetting system having a different architecture from that described herein.

The test strip is preferably a pre-exposed or pre-imaged piece of photographic film or plate material which, after processing, will enable the system operator to determine whether the chemicals within the processor are still active and effective. The determination, for instance, could be made by visual comparison of the processed test strip against a standard. However, it is conceivable that the test strip could provide an indication of active chemical levels within the processor in a similar manner to litmus paper if the test strip was treated with chemicals which react with the chemicals within the processor to cause a specific color reaction on the test strip.

The mechanism for feeding the tests strip into the processor could also vary from system to system. Manual insertion is possible, or feeding the test strip into drive rollers anywhere along the media transfer path of the imagesetting system.

It is to be understood that the above described embodiments are merely illustrative of the present invention and represent a limited number of the possible specific embodiments that can provide applications of the principles of the invention. Numerous and varied other arrangements may be readily devised in accordance with these principles by those skilled in the art without departing from the scope of the invention as claimed.

We claim:

1. A method, for use in an imagesetting system comprising an imagesetter and a wet chemical processor, for testing whether chemicals in the processor are depleted below a level of effectiveness, the method comprising the steps of:

stopping the imagesetter from photographically recording an image onto media and stopping the imagesetter from transferring media to the processor;

installing a light-tight wedge control box, which houses a test strip, into the imagesetting system without physically separating the imagesetter and processor; and running a sequence of operations to extract the test strip from the wedge control box and to transfer the test strip through the processor to determine whether chemicals within the processor are depleted below a level of effectiveness.

2. The method of claim 1 wherein the installing step further comprises feeding a leading edge of the test strip into the imagesetting system.

3. The method of claim 1 further comprising the step of cutting the test strip to a desired length.

4. The method of claim 1 wherein the test strip comprises pre-exposed photographic film.

5. The method of claim 1 wherein the wedge control box is installed onto said imagesetter.

6. The method of claim 1 wherein the wedge control box is installed onto said processor.

* * * * *